US005591388A

United States Patent [19]

Sellars et al.

[11] Patent Number: 5,591,388

[45] Date of Patent: Jan. 7, 1997

[54] METHOD OF MAKING CRIMPED SOLVENT-SPUN CELLULOSE FIBRE

[75] Inventors: Alan Sellars, South Humberside; Patrick A. White, Leicestershire, both of England; Philip I. Robinson, Coventry, United Kingdom

[73] Assignee: Courtaulds Fibres (Holdings) Limited, London, England

[21] Appl. No.: 428,424

[22] Filed: Apr. 25, 1995

Related U.S. Application Data

[63] Continuation of Ser. No. 66,543, May 24, 1993, abandoned.

[51] Int. Cl.[6] ..... D02G 1/12

[52] U.S. Cl. ..... 264/168; 28/267; 264/143; 264/188; 264/198; 264/203; 425/319; 425/325; 425/391

[58] Field of Search ..... 264/143, 168, 264/203, 204, 207, 208, 187, 188, 193, 197, 198; 106/163.1, 168; 28/266, 267; 425/325, 391, 319

[56] References Cited

U.S. PATENT DOCUMENTS

| | | | |
|---|---|---|---|
| Re. 28,906 | 7/1976 | McKinney et al. | 28/267 |
| 2,346,258 | 4/1944 | Hooper | 264/143 |
| 2,575,839 | 11/1951 | Rainard . | |
| 2,865,080 | 12/1958 | Hentschel . | |
| 2,968,857 | 1/1961 | Swerdloff et al. | 264/168 |
| 3,128,147 | 4/1964 | Kenyon et al. | 264/198 |
| 3,628,224 | 12/1971 | Murotani et al. | 28/267 |
| 3,763,527 | 10/1973 | Yazawa | 28/266 |
| 3,767,360 | 10/1973 | Singh | 264/203 |
| 3,911,539 | 10/1975 | Hughes et al. | 28/267 |
| 4,019,229 | 4/1977 | Chastang | 28/267 |
| 4,040,155 | 8/1977 | Hughes et al. . | |
| 4,133,087 | 1/1979 | Li et al. | 28/267 |
| 4,145,391 | 3/1979 | Rodier | 106/163.1 |
| 4,367,191 | 1/1983 | Cuculo et al. | 264/207 |
| 4,416,698 | 11/1983 | McCorsley, III | 106/163.1 |

FOREIGN PATENT DOCUMENTS

| | | |
|---|---|---|
| 731930 | 6/1955 | United Kingdom . |

OTHER PUBLICATIONS

Press, J. J., Man–Made Textile Encyclopedia, Textile Book Publishers, Inc., NY, 1959, pp. 234–237.

"Dethroning King Cotton" by Daniel Green, published in Financial Times, Jan. 5, 1993.

*Primary Examiner*—Jay H. Woo
*Assistant Examiner*—Joseph Leyson
*Attorney, Agent, or Firm*—Fish & Richardson P.C.

[57] ABSTRACT

Staple fibres of solvent-spun cellulose are made by a method in which:

i) cellulose is dissolved in an amine oxide solvent to form a hot cellulose solution, ii) the hot cellulose solution is extruded through a die assembly to form a tow of continuous filaments, iii) the tow is passed through a water bath to leach out the amine oxide, iv) the tow is crimped by passing through a stuffer box in which it is compressed to apply crimp, v) dry steam being injected into the stuffer box during the crimping process, and vi) the crimped tow is passed to a cutter and cut to the desired fibre length. An apparatus is also provided in which the staple fibres can be made.

9 Claims, 3 Drawing Sheets

METHOD OF MAKING CRIMPED SOLVENT-SPUN CELLULOSE FIBRE

This is a continuation of application(s) Ser. No. 08/066,543 filed on May 24, 1993 now abandoned.

BACKGROUND OF THE INVENTION

1. Field of the Invention

This invention relates to the manufacture of crimped cellulose fibre and particularly to the crimping of cellulose fibre that has been made by a method comprising the spinning of continuous cellulose filaments from a solution of cellulose in an organic solvent, particularly an amine oxide solvent. Cellulose manufactured in this manner is known as lyocell and will hereinafter be referred to as solvent-spun cellulose or lyocell. The invention is also concerned to provide useful short, i.e. staple, fibre lengths from the crimped continuous filaments.

2. Description of the Related Art

The manufacture of lyocell cellulose filaments is described in, for example, U. S. Pat. No. 4,416,698 the contents of which are incorporated herein by way of reference. This Patent discloses a method of producing cellulose filaments by dissolving the cellulose in a suitable solvent such as a tertiary amine N-oxide.

A hot solution of the cellulose is extruded or spun through a suitable die assembly including a jet to produce filamentary material which is passed into water to leach out the amine oxide solvent from the extruded filaments.

The production of artificially formed filaments of material by extruding or spinning a solution or liquid through a spinnerette to form the filaments is, of course, well known. Initially, relatively small numbers of individual filaments were prepared, which filaments were individually wound up for use as continuous filament material. This meant that the number of continuous filaments which needed to be produced was essentially dictated by the number of filaments which could be individually wound either before or after drying.

However, if fibre is produced as a tow or if fibre is produced as a staple fibre then different criteria apply to the number of filaments which can be produced at any one time. A tow essentially comprises a bundle of essentially parallel filaments which are not handled individually. Staple fibre essentially comprises a mass of short lengths of fibre. Staple fibre can be produced by the cutting of dry tow or it can be produced by forming a tow, cutting it whilst still wet, and drying the cut mass of staple fibre.

Because there is no need to handle individual filaments in the case of a tow product or a staple product, large numbers of filaments can be produced simultaneously.

Thus the tow of cellulose filaments is cut before or after drying to form the desired mass of short lengths of staple fibre.

Natural cellulose fibres have a natural crimp, which is advantageous in providing frictional properties when the fibres are put to use, e.g. directly for non-woven products or for the production of yarns from woven or knitted products. Lyocell, however, does not have an inherently natural crimp.

It is, therefore, an object of the present invention to provide fibre from lyocell cellulose filaments in which the fibre has a crimp applied to it.

SUMMARY OF THE INVENTION

Accordingly in one aspect the invention provides a method of making staple fibres of solvent-spun cellulose in which:

i) cellulose is dissolved in an amine oxide solvent to form a hot cellulose solution, ii) the hot cellulose solution is extruded through a die assembly to form a tow of continuous filaments, iii) the tow is passed through a water bath to leach out the amine oxide iv) the tow is crimped by passing through a stuffer box in which it is compressed to apply crimp, v) dry steam being injected into the stuffer box during the crimping process, and vi) the crimped tow is passed to a cutter and cut to the desired fibre length.

In a second aspect the invention provides an apparatus for the production of staple fibres of solvent-spun cellulose which comprises:

i) a mixer to receive shredded cellulose and an amine oxide solvent for the cellulose to form a solution of cellulose in the amine oxide, ii) pumping means to pump the cellulose solution from the mixer to iii) an extruder die assembly having a multiplicity of holes through which the solution may be spun to form a tow of continuous filaments, iv) means to transport the tow to v) a water bath in which the amine oxide may be leached out, vi) means to transport the tow of so-formed cellulose to vii) a crimping means, the crimping means comprising a nip leading to a stuffer box in which the tow may be crimped, viii) means to inject dry steam into the stuffer box, and ix) means to transport the crimped tow to x) a cutter where the crimped tow may be cut to the desired fibre length.

The amine oxide used is preferably a tertiary amine N-oxide. The source of cellulose may conveniently be shredded paper or shredded wood pulp.

The mixer and pumping means may be any suitable means, for example as conventionally used in the manufacture of regenerated cellulose.

Similarly, the extruder die assembly may be any conventionally used in the manufacture of filamentary tows. It may include a spinnerette of the type disclosed in copending U.S. patent application Ser. No.08/066,779 entitled "Spinnerette" the contents of which are also incorporated herein by way of reference.

The means to transport the tow at the various stages similarly may be conventional means including rollers and pulling means.

The invention is equally applicable to the crimping of tows of lyocell that have been previously manufactured. Thus tow from a storage spool may be fed to the crimping means of the invention, crimped and then stored or cut to the desired length. Similarly, it is not essential to the invention that the crimped tow be cut as part of a continuous process after crimping. It may be found more convenient to store the crimped tow, e.g. on spools. If desired, it may then be cut to any desired length at a later stage. Thus the cutting may be "on-line" or "off-line" with respect to the crimping process and the crimping may be "off-line" or "on-line" with respect to the tow manufacturing process.

The stuffer box may be, for example, of any conventionally used design but adapted to receive an injection of dry steam.

We have found that the use of a dry steam is an important feature of the invention and that it is necessary to avoid the presence of water droplets in the steam in the stuffer box. The use of dry steam appears to fix the applied crimp to the tow so that a reliable and longer lasting crimp is achieved. Thus, for example, slightly superheated steam at, say, from 5 p.s.i. up to 70 p.s.i. or higher may usefully be used.

BRIEF DESCRIPTION OF THE DRAWINGS

The invention will now be further described by way of example only with reference to the accompanying drawings in which.

DESCRIPTION OF THE PREFERRED EMBODIMENTS

Figure 1:
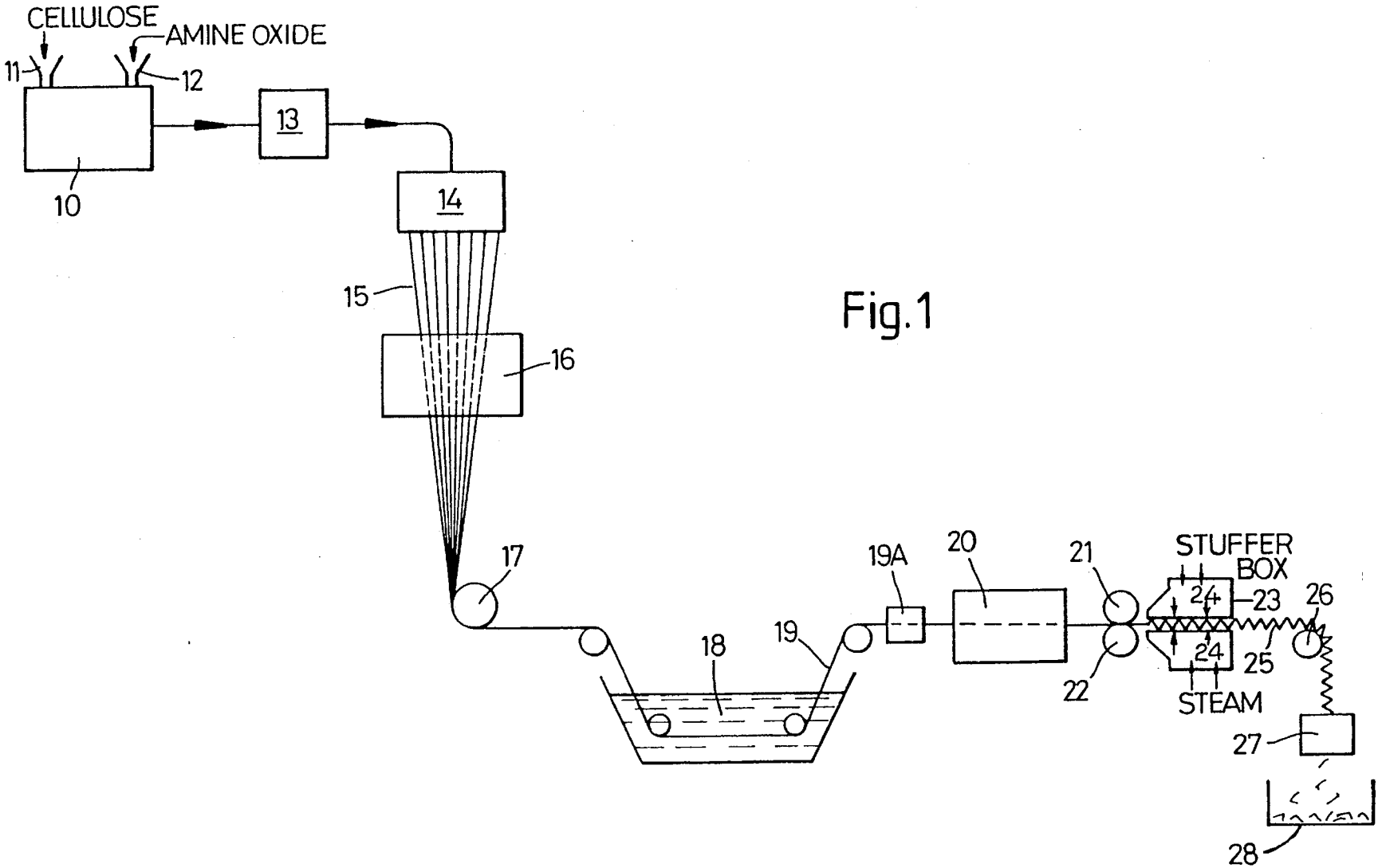
FIG. 1 is a diagrammatic representation of the various stages in the manufacture of crimped staple fibres of solvent-spun cellulose i.e. lyocell.

In FIG. 1, is shown a mixer 10 with inlets 11 and 12 to receive shredded cellulose and an amine oxide solvent respectively. The hot solution is pumped via metering pump 13 to a spinnerette 14 where the solution is spun into a continuous tow 15 of fibres.

As the hot tow leaves the spinnerette 14 it is passed through a spin bath 16 in which a mixture of water and the amine oxide is recirculated. At start-up there will be no amine oxide in the spin bath but its proportion to water may rise to about 40% by weight, e.g. 25% by weight. From spin bath 16 the tow is passed via roll 17 through a water bath 18. The tow passing through the water bath may be, for example, up to 12 to 14 inches wide. In the water bath, the amine oxide is dissolved out of the fibres and the tow 19 emerging from the water bath is of lyocell.

From water bath 18 the tow 19 is passed through a finishing stage 19A where the filaments are lubricated using spin finishes well known in the art. The tow is then passed through a drying oven 20 maintained at a temperature of from about 100° to 180° C., e.g. 165°C.

The drying oven is preferably of the perforated drum type, well known in the art, but may, alternatively be of the can or calender drier type.

There may be, as shown, a single tow emerging from the spinnerette and this may contain, for example, up to 400,000 filaments and may weigh, for example, 65 ktex, i.e. 65g/meter, after the drying stage. Alternatively, the spinnerette may produce more than one, for example, four streams of tow and these may contain over 1 million filaments each and weigh, for example, about 181 ktex each after drying.

A single tow passing through the water bath may be, as indicated above, up to 12 to 14 inches wide. However, where four tows, for example, are produced from the spinnerette, these may be combined into two tows, each pair of tows going through a separate water bath which is at least 48 inches wide and each pair of tows 24 inches wide.

The dry tow from drier 20 is then passed into a nip defined by rolls 21 and 22 from which it is fed into stuffer box 23. Dry steam is fed into the stuffer box via inlets 24. The crimped tow 25 emerging from the stuffer box is passed via roll 26 to a cutter 27 where it is cut to staple fibre lengths. The crimped staple fibre lengths are collected in box 28.

As the tow emerges from stuffer box 23, it may have been compressed, for example, to a width of about 2 inches and it may be allowed to widen to, for example 6 to 8 inches as it passes to the cutter. Alternatively the tow emerging from the stuffer box may have been compressed to a width of say, 4 to 5½ inches and is then allowed to widen to 12 to 18 inches as it passes to the cutter.

The degree of crimp applied in the stuffer box may be, for example 2 to 15 primary crimps per inch. (It will be appreciated that fibres with primary crimp 34*a* may be either straight or of wavy formation, i.e. they may also have secondary crimp 34.)

Following drying, where more than one tow is being processed, the individual tows may be passed to individual crimpers or combined to a single tow of typically 400,000 to 2 million plus filaments which is then passed to a single crimper.

The grades or lengths of staple fibre cut in the cutter 27 will depend on the intended end use of the staple fibres. Thus, for example, lengths of 4 to 15 mm may be required for paper making, 15 to 60 mm for use in cotton-type yarns and 60–150 mm for use in worsted-type yarns.

Figure 2A:
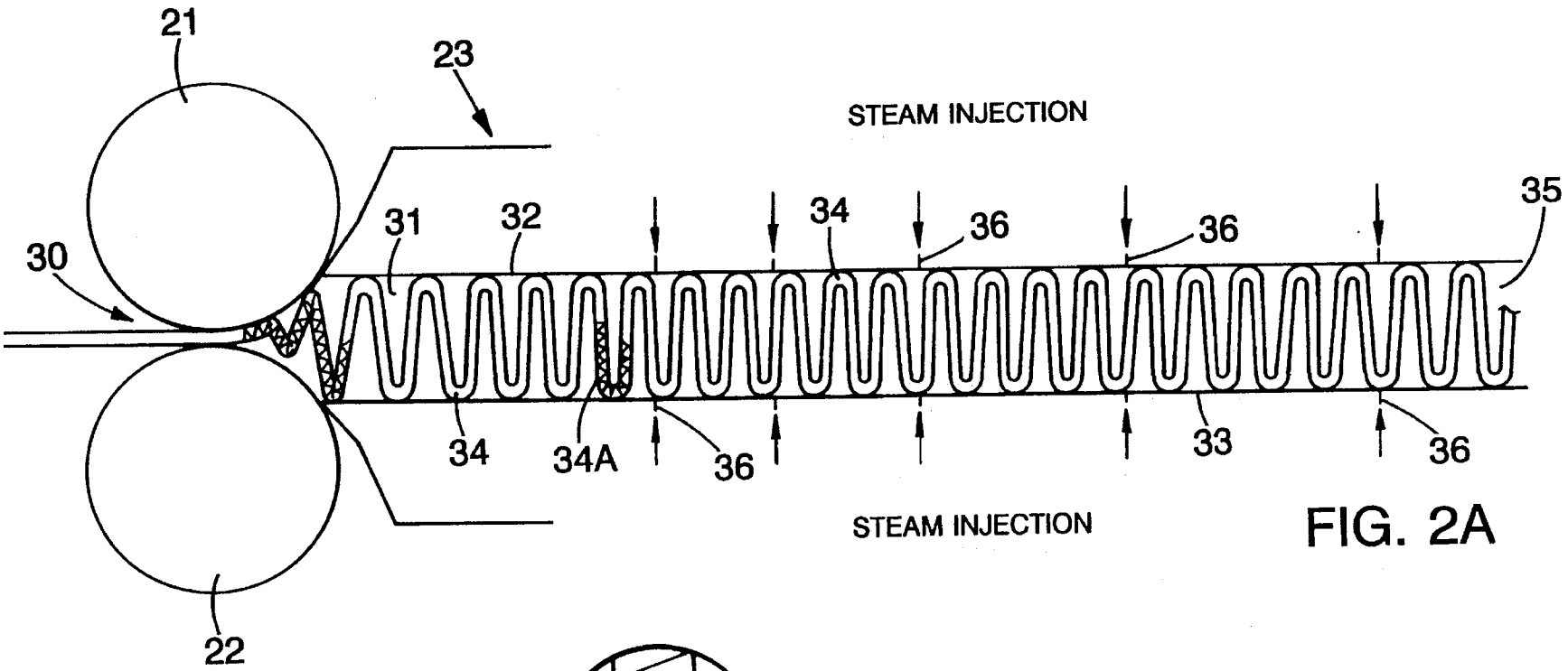
FIG. 2A is a diagrammatic representation of the crimping stage of the manufacturing process in which the tow of cellulose is passed through a stuffer box.
Figure 2B:
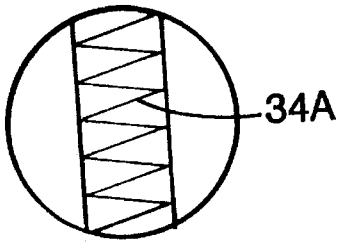
FIG. 2B is an enlarged view of part of the crimped tow shown in FIG. 2A.

The crimping stage of the process is shown in more detail in FIGS.2A and 2B.

The tow is passed into a nip 30 between rolls 21 and 22 and is fed from nip 30 into stuffer box 23 at a rate sufficient to fill passageway 31 of the stuffer box, which is defined between plates 32 and 33 and extends from the exit of the nip to the exit 35 of the stuffer box, whereby creasing or crimping of the filaments at regular longitudinal intervals is caused. The crimped tow is compressed between plates 32 and 33 in the stuffer box as shown to form a series of loops 34 (shown spaced out in the drawing for clarity) and emerges at exit 35 in permanently crimped form. Dry steam is injected into the stuffer box and passes through holes 36 in plates 32 and 33 to contact the tow as it passes along passageway 31.

Figure 3:
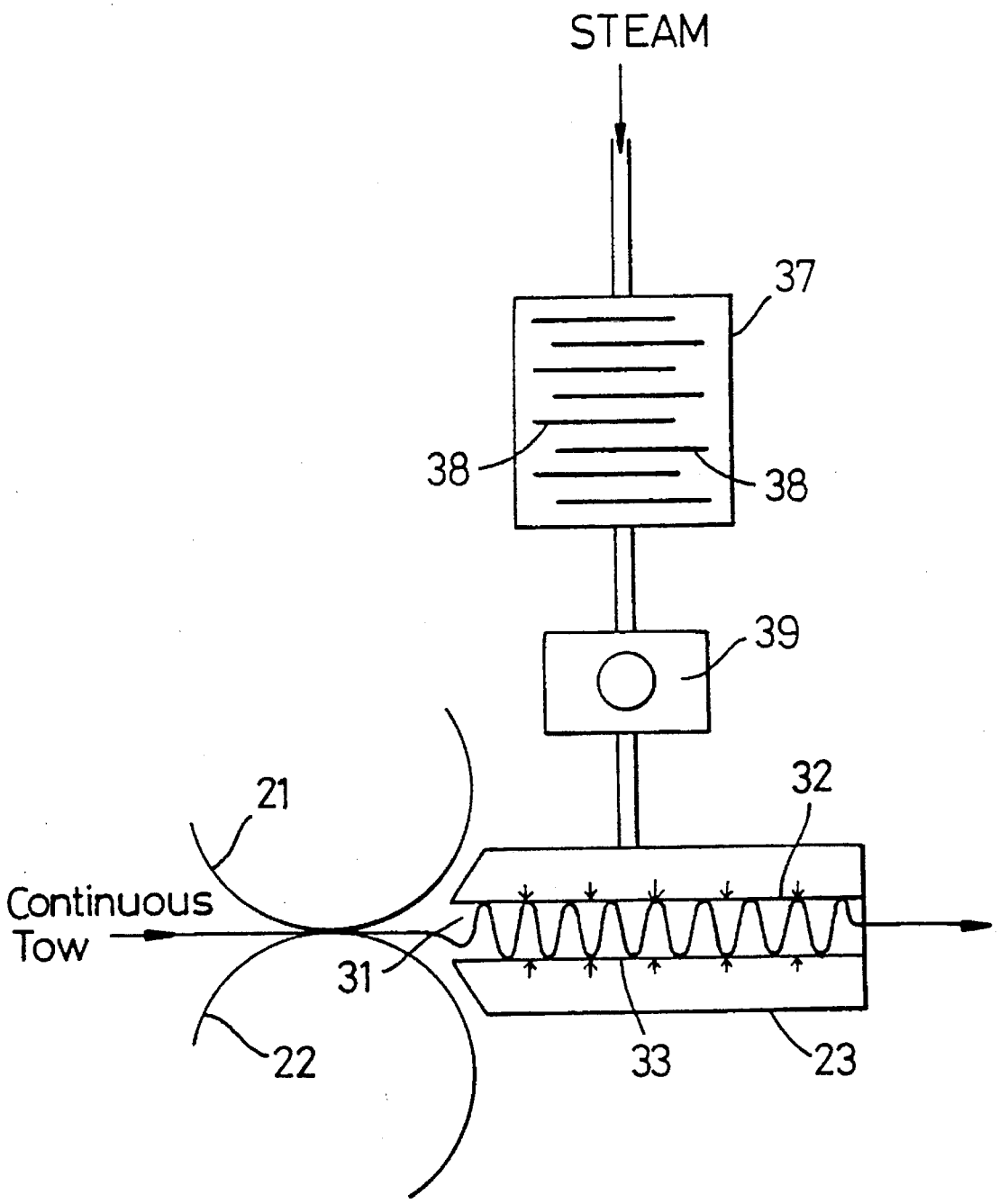
FIG. 3 is a diagrammatic representation of the steam supply to the stuffer box.

As illustrated in FIG. 3, steam from a source at, for example, 85 p.s.i. is passed through a drier 37 comprising a series of baffle plates 38. The dry steam is then passed through a pressure reduction valve 39, e.g. a -9- simple diaphragm reducing valve, where its pressure is reduced to, for example, 65 p.s.i. or 45 p.s.i. The dry, reduced pressure steam is then fed into stuffer box 23 where it passes through the holes in plates 32 and 33 to contact the crimped tow in passageway 31 as described above.

As indicated previously, it is not essential for the crimped tow to pass directly to a cutter and it may instead be collected and stored on suitable spools or plaited into cans or boxes. Moreover, it is not necessary that the continuous tow be fed to the crimper directly from the tow manufacturing process. Previously manufactured and stored uncrimped tow may be used as the source to feed the crimper.

We claim:

1. A method of crimping solvent-spun cellulose filaments comprising passing a tow of continuous filaments of solvent-spun cellulose through the nip of a pair of rollers and thence into a stuffer box, crimping said tow in said stuffer box and injecting dry steam into the stuffer box to contact the filaments as they are crimped.

2. A method according to claim 1 crimped and comprising passing the crimped tow to a cutter and cutting the crimped tow to staple fibre length.

3. A method according to claim 1 and comprising passing the crimped tow to storage means.

4. A method for making staple fibres from solvent-spun cellulose which comprises dissolving cellulose in an amine oxide solvent to form a hot cellulose solution, extruding the hot cellulose solution through a die assembly to form a tow of continuous filaments, passing the tow through a water bath to leach out the amine oxide, crimping the tow by passing the leached tow through a stuffer box while injecting dry steam into the stuffer box, withdrawing the crimped tow from the stuffer box and cutting it to the desired staple fibre length.

5. A method according to claim 4 and comprising passing the tow through a drying oven between the water bath and the stuffer box.

6. A method according to claim 5, in which the temperature in the drying oven is from 100° to 180° C.

7. A method according to claim 4 in which the steam injected into said stuffer box is dry superheated steam at from 5 to 70 p.s.i.

8. A method according to claim 7, in which said dry superheated steam is at about 65 p.s.i.

9. A method according to claim 5, in which the amine oxide solvent comprises a tertiary amine N-oxide.

* * * * *

UNITED STATES PATENT AND TRADEMARK OFFICE

CERTIFICATE OF CORRECTION

PATENT NO. : 5,591,388

DATED : January 7, 1997

INVENTOR(S) : Alan Sellars, Patrick A. White, Philip I. Robinson

It is certified that error appears in the above-identified patent and that said Letters Patent is hereby corrected as shown below:

In the claims

Claim 2, line 1, after "claim 1" delete "crimped".

Claim 9, line 1, change "claim 5" to --claim 4--.

Signed and Sealed this

Twenty-eighth Day of April, 1998

Bruce Lehman

*Attest:*

BRUCE LEHMAN

*Commissioner of Patents and Trademarks*

*Attesting Officer*